US007305735B2

(12) United States Patent
Overvaag

(10) Patent No.: US 7,305,735 B2
(45) Date of Patent: Dec. 11, 2007

(54) VACUUM CLEANER EQUIPPED WITH DIRT CUP AND SEPARATE FILTER DRAWER

(75) Inventor: Chad D. Overvaag, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 615 days.

(21) Appl. No.: 10/683,188

(22) Filed: Oct. 10, 2003

(65) Prior Publication Data

US 2004/0074042 A1 Apr. 22, 2004

Related U.S. Application Data

(60) Provisional application No. 60/417,790, filed on Oct. 11, 2002.

(51) Int. Cl.
*A47L 9/10* (2006.01)
*B01D 41/00* (2006.01)

(52) U.S. Cl. ..... 15/352; 55/429; 55/DIG. 3

(58) Field of Classification Search ..... None
See application file for complete search history.

(56) References Cited

U.S. PATENT DOCUMENTS

| | | | | |
|---|---|---|---|---|
| 5,230,722 | A | 7/1993 | Yonkers | |
| 5,681,363 | A * | 10/1997 | Tucker et al. | 55/300 |
| 6,311,366 | B1 | 11/2001 | Sepke et al. | |
| 6,341,404 | B1 * | 1/2002 | Salo et al. | 15/353 |
| 6,406,505 | B1 * | 6/2002 | Oh et al. | 55/337 |
| 6,532,620 | B2 * | 3/2003 | Oh | 15/353 |
| 2002/0166199 | A1 * | 11/2002 | Boles et al. | 15/352 |

FOREIGN PATENT DOCUMENTS

| | | |
|---|---|---|
| JP | 56-136642 | 10/1981 |
| JP | 56-136650 | 10/1981 |

* cited by examiner

*Primary Examiner*—David Redding
(74) *Attorney, Agent, or Firm*—King & Schickli, PLLC

(57) ABSTRACT

A vacuum cleaner includes a housing, a nozzle inlet, a suction generator, a dirt cup and a filter assembly. The suction generator, dirt cup and filter assembly are all carried on the housing. The dirt cup includes an inlet and an outlet that provide fluid communication between the nozzle inlet, the dirt cup and the suction generator. The filter assembly is also provided in fluid communication with the nozzle inlet, the suction generator and the dirt cup. The filter assembly includes a filter holder displaceable between an open position and a closed position and a filter element that is held in the filter holder.

24 Claims, 3 Drawing Sheets

VACUUM CLEANER EQUIPPED WITH DIRT CUP AND SEPARATE FILTER DRAWER

This application claims the benefit of U.S. Provisional Patent Application Ser. No. 60/417,790 filed Oct. 11, 2002.

TECHNICAL FIELD

The present invention relates generally to the floor care equipment field and, more particularly, to a dirt collection assembly for an upright or canister vacuum cleaner as well as to an upright or canister vacuum cleaner incorporating that dirt collection assembly.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, an improved vacuum cleaner is provided. That vacuum cleaner comprises a housing, a nozzle inlet, a suction generator carried on the housing, a dirt cup carried on the housing and a filter assembly carried on the housing. The dirt cup has an inlet and an outlet providing fluid communication between the nozzle inlet, the dirt cup and the suction generator. The filter assembly is also provided in fluid communication with the nozzle inlet, the suction generator and the dirt cup. The filter assembly includes a filter holder displaceable between an open position and a closed position and a filter element held in the filter holder.

More specifically describing the invention, the dirt cup includes a sidewall and a bottom wall. The inlet is provided in the sidewall. The outlet is provided in the bottom wall. A screen may be provided in the dirt cup across the outlet in order to trap relatively coarse dirt and debris in the dirt cup. Further, the dirt cup may include an open top and a lid that closes the open top. When the dirt cup is removed from the vacuum cleaner, the lid may be removed from the dirt cup in order to dump dirt and debris from the dirt collection chamber defined by the dirt cup.

In one possible embodiment that dirt collection chamber is substantially cylindrical in shape. Additionally, the inlet is tangentially directed relative to the dirt collection chamber so as to provide cyclonic airflow in that chamber. For certain applications, cyclonic airflow may enhance the cleaning efficiency of the vacuum cleaner.

The filter assembly includes an internal filter chamber and an inlet in fluid communication with that filter chamber. The filter holder includes a cavity for receiving and holding the filter element. Further the filter holder may include a grating allowing air to flow through the filter element.

In one possible embodiment the filter assembly is connected to the dirt cup and removable from the housing with the dirt cup. In an alternative embodiment, the dirt cup is removable from the housing independent of the filter assembly.

The vacuum cleaner may be a canister vacuum cleaner or an upright vacuum cleaner. In an upright vacuum cleaner the housing includes a nozzle section including the nozzle inlet and a canister section. The nozzle section and canister section are pivotally connected together. The dirt cup is received in the canister section. The suction generator and the filter assembly may also be received in the canister section. Still further, the filter holder may comprise a drawer that slides in and out of the filter assembly.

In accordance with yet another aspect of the present invention, a dirt cup assembly is also provided. That dirt collection assembly includes a dirt collection chamber and an inlet and an outlet in fluid communication with the dirt collection chamber and a filter assembly. The filter assembly includes a filter chamber, a filter drawer and a filter element received in the filter drawer. A screen may be provided across the outlet. Further the filter drawer may include an open top, at least one sidewall and a bottom wall grating defining a recess for holding the filter element. Additionally, the dirt cup includes a sidewall, a bottom wall and a lid. The inlet is positioned in the sidewall and the outlet is positioned in the bottom wall.

In the following description there is shown and described multiple embodiments of this invention simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
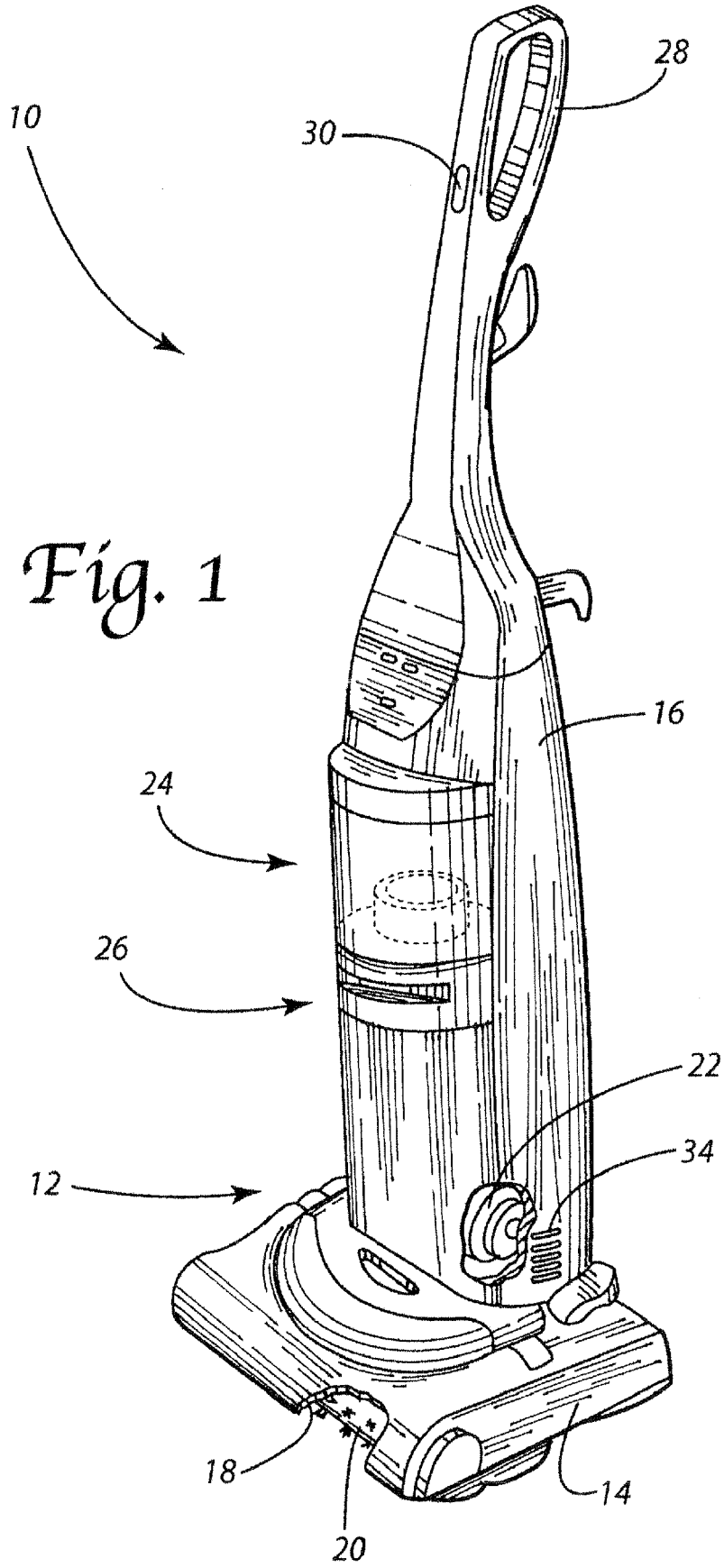
FIG. 1 is a perspective view of one possible embodiment of the vacuum cleaner of the present invention.

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent covers canister vacuum cleaners.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner 10 to and fro across the floor. Wheels (not shown) carried on the housing 12 allow the vacuum cleaner 10 to be moved smoothly across the floor.

As illustrated, the nozzle section 14 is equipped with a nozzle inlet 18. In the illustrated embodiment, the nozzle inlet 18 also includes a rotary agitator 20.

The canister section 16 houses a suction generator 22 (i.e. a fan and motor assembly), a dirt cup 24 and a filter assembly 26. The canister section 16 also includes a control handle 28 and an actuator switch 30 for turning the vacuum cleaner 10 on and off and thereby driving the rotary agitator 20 and the suction generator 22.

During the cleaning operation the rotary agitator 20 brushes and beats dirt and debris from the nap of an underlying carpet being cleaned. That dirt and debris is then drawn by the suction generator 22 through the nozzle inlet 18 into the dirt cup 24 where the majority of the dirt and debris and, more particularly, the relatively coarse dirt and debris is collected. Next, the relatively clean air is drawn through the filter assembly 26 where a filter element 32 cleans the air of substantially any remaining fine particles that are able to pass through the dirt cup 24. The airstream is then directed over the motor of the suction generator 22 to provide cooling before being routed through a final filter, to remove any carbon particles stripped from the brushes of the motor by the airstream, before exhausting the airstream through an exhaust port 34 into the environment.

Figure 2:
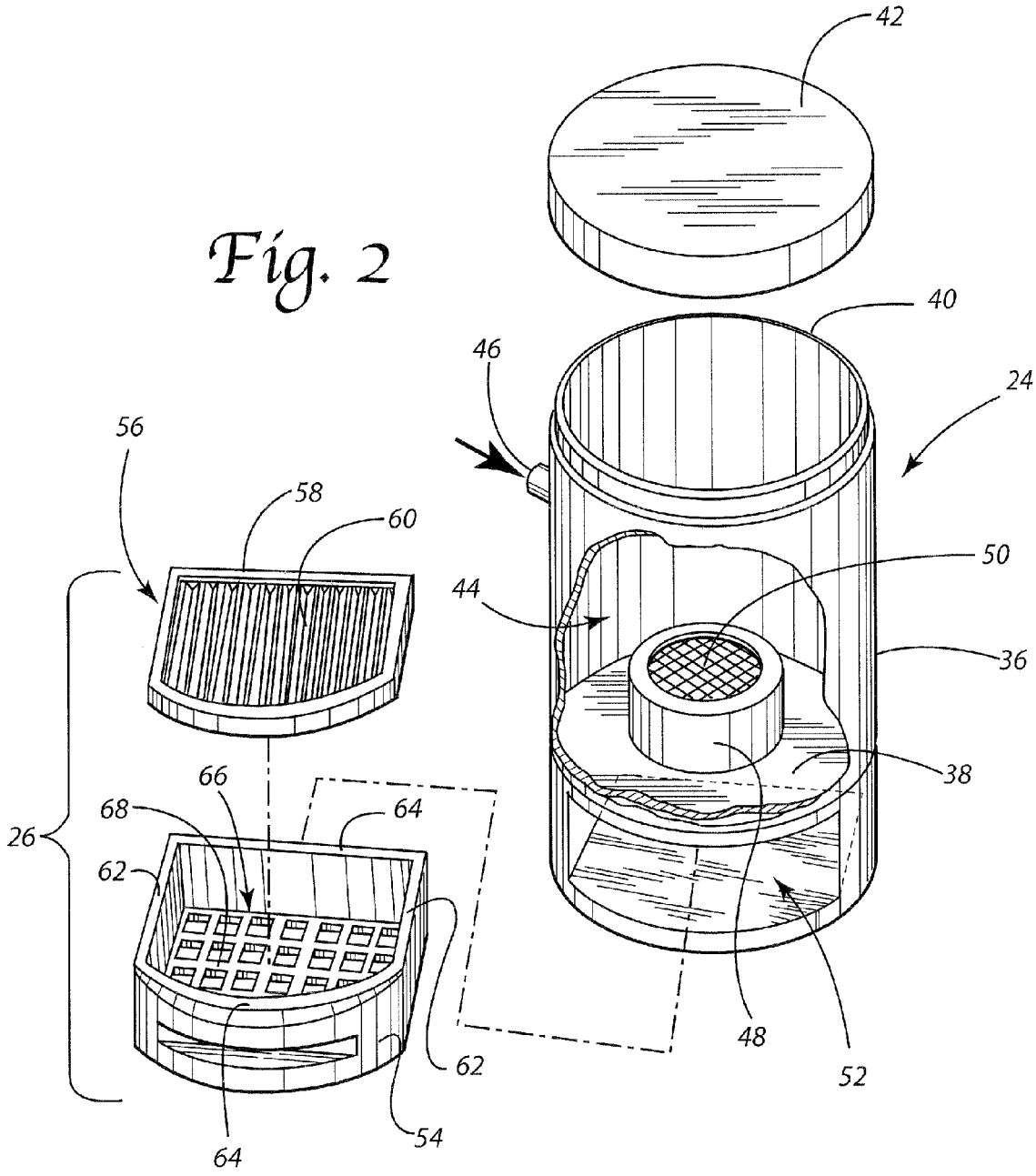
FIG. 2 is a detailed perspective view of a combined dirt cup and filter assembly removed from the housing of the embodiment of the present invention illustrated in FIG. 1.

Reference is now made to FIG. 2 showing one possible embodiment of the present invention. In this embodiment, the dirt cup 24 and filter assembly 26 are removable as one assembly from the canister section 16. As illustrated, the dirt cup 24 includes a sidewall 36, a bottom wall 38 and an open top 40 closed by a removable lid 42. Together, the sidewall 36, bottom wall 38 and removable lid 42 define a dirt collection chamber 44. An inlet 46 is provided in the sidewall 36. An outlet 48 is provided in the bottom wall 38.

In one possible embodiment the dirt collection chamber 44 in the dirt cup 24 is substantially cylindrical in shape. Further, the inlet 46 is tangentially directed along the sidewall 36 so that cyclonic airflow is established in the dirt collection chamber 44. For certain applications such airflow may aid in cleaning efficiency.

Whether or not the necessary structure is provided to establish cyclonic airflow in the dirt cup 24, it should be appreciated that a screen 50 covers the outlet 48. Accordingly, dirt and debris too coarse to pass through the screen 50 is trapped in the dirt collection chamber 44 in the dirt cup 24. This debris may be periodically dumped from the dirt cup by removing the lid 42 and emptying the contents of the dirt cup 24 into a garbage can, trash bag or the like. The lid may then be repositioned on the sidewall 36 and the dirt cup 24 recornected to the canister section 16.

As further illustrated in FIG. 2, the filter assembly 26 comprises an internal filter chamber 52, a filter holder 54 displaceable between an open position illustrated in FIG. 2 and a closed position illustrated in FIG. 1, and a filter element 56 for cleaning and holding fine dirt and debris that passes through the screen 50. In the illustrated embodiment the filter element 56 includes a frame 58 for holding and supporting a filter material 60 of a type well known in the art to be useful in vacuum cleaners.

The filter holder 54 in the illustrated embodiment takes the form of a drawer that slides in and out of the filter chamber 52. More specifically, the filter holder 54 includes two sidewalls 62 and two end walls 64 that define a cavity 66 for receiving and holding the filter element 56. The bottom wall 68 of the filter holder 54 is a grating that allows air to flow freely through the filter material 60 of the filter element. As should be appreciated, the top of the filter chamber 52 is open so as to form an inlet that is in fluid communication with the outlet 48 of the dust cup 24. The grating or bottom wall 68 of the filter holder 54 functions as an outlet that is in fluid communication with the suction generator 22. Accordingly, in the illustrated embodiment, air is drawn serially through the nozzle inlet 18, the dirt cup 24, the filter assembly 26 and the suction generator 22 before being exhausted to the environment through the exhaust port 34.

Eventually, the cleaning performance of the vacuum cleaner 10 may become impaired by a dirty filter element 56. The filter element 56 is easily serviced by opening the filter holder 54. In the illustrated embodiment the filter holder 54 slides like a drawer to expose the dirty filter element 56. The dirty filter element 56 is then removed and either cleaned or replaced by a new filter element which is dropped right in the cavity 66. The filter holder 54 is then closed as illustrated in FIG. 1 and the vacuum cleaner 10 is again ready for operation.

Figure 3:
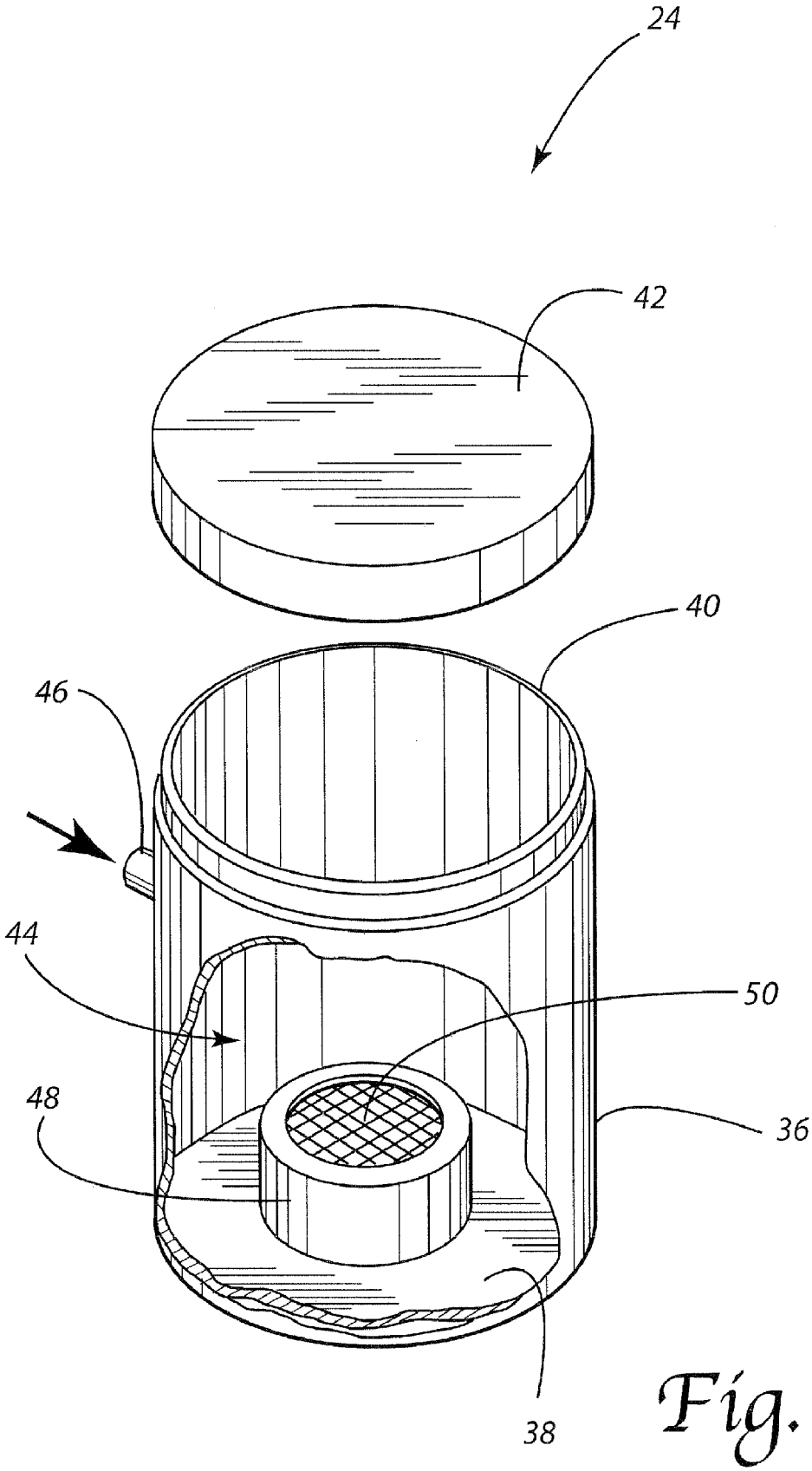
FIG. 3 is a view similar to FIG. 2 but showing a second possible embodiment wherein the dirt cup is independently removable from the housing without the filter assembly.

In an alternative embodiment illustrated in FIG. 3, the dust cup 24 and the filter assembly 26 are separate rather than combined structures. Additionally, as illustrated, the dust cup 24 may be removed from the canister section 16 independently of the filter assembly 26.

The foregoing description of the preferred embodiments of this invention have been presented for purposes of illustration and description. It is not intended to be exhaustive or to limit the invention to the precise form disclosed. Obvious modifications or variations are possible in light of the above teachings.

For example, while the illustrated embodiment is an upright vacuum cleaner, the present invention also relates to and includes canister and hand-held vacuum cleaners. Further, while the illustrated embodiment is a "clean air" system with the suction generator 22 downstream from the dirt cup 24 and filter assembly 26, the present invention also includes "dirty air" systems where the suction generator is located upstream of either or both of these structures.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed:

1. A vacuum cleaner, comprising:

a housing;

a nozzle inlet;

a suction generator carried on said housing;

a dirt cup carried on said housing and having an inlet and an outlet, said inlet and said outlet providing fluid communication between said nozzle inlet, said dirt cup and said suction generator; said outlet is provided in a bottom wall of said dirt cup; and a filter assembly positioned outside said dirt cup and in fluid communication with said nozzle inlet, said suction generator and said dirt cup, said filter assembly including a filter holder and a filter element held in said filter holder, wherein said filter assembly and dirt cup are removable as one assembly from the housing.

2. The vacuum cleaner of claim 1 wherein said dirt cup includes a sidewall.

3. The vacuum cleaner of claim 2, wherein said inlet is provided in said sidewall.

4. The vacuum cleaner of claim 2, wherein said dirt cup includes a dirt collection chamber that is substantially cylindrical in shape and said inlet is tangentially directed relative to said dirt collection chamber.

5. The vacuum cleaner of claim 2, wherein said dirt cup includes an open top and a lid closing said open top.

6. The vacuum cleaner of claim 5, wherein said filter assembly includes an internal filter chamber and an inlet in fluid communication with said filter chamber.

7. The vacuum cleaner of claim 6, wherein said filter holder includes a cavity receiving said filter element.

8. The vacuum cleaner of claim 7, wherein said filter holder includes a grating allowing air to flow through said filter element.

9. The vacuum cleaner of claim 7, wherein said filter holder is a drawer that slides in and out of said filter assembly.

10. The vacuum cleaner of claim 1, wherein a screen is provided in said dirt cup across said outlet.

11. The vacuum cleaner of claim 1, wherein said filter assembly includes an internal filter chamber and an inlet in fluid communication with said filter chamber.

12. The vacuum cleaner of claim 11, wherein said filter holder includes a cavity receiving said filter element.

13. The vacuum cleaner of claim 12, wherein said filter holder includes a grating allowing air to flow through said filter element.

14. The vacuum cleaner of claim 1, wherein said filter assembly is directly connected to said dirt cup and removable from said housing with said dirt cup.

15. The vacuum cleaner of claim 1, wherein said housing includes a nozzle section including said nozzle inlet and a canister section.

16. The vacuum cleaner of claim 15, wherein said dirt cup is received in said canister section.

17. The vacuum cleaner of claim 16, wherein said suction generator and said filter assembly are received in said canister section.

18. The vacuum cleaner of claim 17, wherein said nozzle section and said canister section are pivotally connected together.

19. The vacuum cleaner of claim 1, wherein the filter holder is displaceable between an open position and a closed position.

20. A vacuum cleaner, comprising:

a housing including a nozzle section having a nozzle inlet and a canister section;

a suction generator carried on said housing;

a dirt cup carried on said housing and having an inlet and an outlet, said inlet and said outlet providing fluid communication between said nozzle inlet, said dirt cup and said suction generator; and a filter assembly positioned outside said dirt cup and in fluid communication with said nozzle inlet, said suction generator and said dirt cup, said filter assembly including a filter holder and a filter element held in said filter holder, wherein said filter assembly and dirt cup are removable as one assembly from the housing.

21. The vacuum cleaner of claim 20, wherein said dirt cup is received in said canister section.

22. The vacuum cleaner of claim 21, wherein said suction generator and said filter assembly are received in said canister section.

23. The vacuum cleaner of claim 22, wherein said nozzle section and said canister section are pivotally connected together.

24. The vacuum cleaner of claim 20, wherein the filter holder is displaceable between an open position and a closed position.

* * * * *